United States Patent [19]

Takeuchi

[11] Patent Number: 5,019,491

[45] Date of Patent: May 28, 1991

[54] SILVER HALIDE PHOTOGRAPHIC MATERIAL

[75] Inventor: Kazuhiko Takeuchi, Kanagawa, Japan

[73] Assignee: Fuji Photo Film Co., Ltd., Kanagawa, Japan

[21] Appl. No.: 595,622

[22] Filed: Oct. 9, 1990

Related U.S. Application Data

[63] Continuation of Ser. No. 329,153, Mar. 27, 1989, abandoned.

[30] Foreign Application Priority Data

Mar. 25, 1988 [JP] Japan ..... 63-71029

[51] Int. Cl.[5] ..... G03C 1/76

[52] U.S. Cl. ..... 430/523; 430/527; 430/529; 430/531; 430/631; 430/635; 430/636; 430/637

[58] Field of Search ..... 430/523, 527, 529, 531, 430/631, 635, 636, 637

[56] References Cited

U.S. PATENT DOCUMENTS

| | | | |
|---|---|---|---|
| 3,551,152 | 12/1970 | Mackey et al. | 430/527 |
| 3,625,692 | 12/1971 | Meyer et al. | 430/631 |
| 4,004,927 | 1/1977 | Yamamoto et al. | 430/631 |
| 4,047,958 | 9/1977 | Yoneyama et al. | 430/531 |
| 4,267,266 | 5/1981 | Shibue et al. | 430/527 |
| 4,363,871 | 12/1982 | Shibue et al. | 430/527 |
| 4,675,278 | 6/1987 | Sugimoto et al. | 430/523 |

*Primary Examiner*—Hoa Van Le

*Attorney, Agent, or Firm*—Sughrue, Mion, Zinn, Macpeak & Seas

[57] ABSTRACT

A silver halide photographic material composed of a support having thereon at least one light-sensitive silver halide emulsion layer, at least one layer of the material containing the combination of a lubricant and a water-soluble compound represented by formula (I):

$$A\text{-}X\text{-}Y\text{-}B \qquad (I)$$

wherein A represents an alkyl group, alkenyl group or aryl group which has from 8 to 25 carbon atoms; X represents —O—, $$-\underset{\underset{O}{\|}}{C}O-,$$

—S—, $$-\underset{\underset{R}{|}}{N}-,\quad -\underset{\underset{R}{|}}{C}ON-\quad \text{or}\quad -SO_2\underset{\underset{R}{|}}{N}-,$$

wherein R represents an alkyl group containing from 1 to 10 carbon atoms or -Y-B; Y consists of at least $-(CH_2CH_2O)_a-$ and $$-(CH_2\underset{\underset{OH}{|}}{C}HCH_2O)_b-,$$

wherein a is an integer from 5 to 50, and b is an integer from 2 to 20; and B represents hydrogen, an alkyl group containing at most 8 carbon atoms, or a phenyl group. The material has superior developement and drying characteristics, particularly in avoidance of droplet marks.

18 Claims, No Drawings

SILVER HALIDE PHOTOGRAPHIC MATERIAL

This is a continuation of application Ser. No. 329,153, filed Mar 27, 1989, now abandoned.

FIELD OF THE INVENTION

This invention concerns silver halide photographic materials which have good slip properties and, in particular, silver halide photographic materials with good wetting properties, even drying and even development.

BACKGROUND OF THE INVENTION

Silver halide photographic materials are liable to surface scratching and abrasion due to contact friction with various materials during coating, drying and finishing in manufacture, and during winding and rewinding or transporting when the material is being used for taking photographs, development processing exposure and projection, for example. They are also liable to other undesirable effects such as poor sensitive material driving properties in cameras and projectors. With silver halide photographic materials in particular, the silver halide which is used as the photosensitive substance is also very sensitive to pressure, and damage to the film causes pressure fogging and desensitization, which has an adverse effect on the photographic image.

Consequently, various methods have been put forward in the past for improving the physical properties of photosensitive materials so that they are less prone to damage and have improved driving properties by reducing the normal sliding friction of silver halide photographic materials.

Known methods of reducing the sliding friction of silver halide photographic materials include, for example, including dimethylsilicones and specified surfactants in the photographic emulsion layers or protective layers as disclosed in U.S. Pat. No. 3,042,522; including a triphenyl terminal block methylphenylsilicone in the protective layer, as disclosed in British Patent 1,143,118; including the ester compounds disclosed in U.S. Pat. No. 3,121,060; and including the ester compounds disclosed in JP-A-51-14163. (The term "JP-A" as used herein means "unexamined published Japanese patent application".

However, when these lubricant are used, undesirable droplet-like marks (referred to below as droplet marks) are formed on drying after photographic processing.

SUMMARY OF THE INVENTION

One object of this invention is to provide photographic materials which have excellent slip properties and resistance to damage, which are free from formation of droplet marks.

It has now been found that this and other objects of the invention are realized in photographic materials which are composed of a support having thereon at least one light-sensitive silver halide emulsion layer at least one layer of the material containing the combination of a lubricant and a compound represented by formula (I):

$$A\text{-}X\text{-}Y\text{-}B \qquad (I)$$

wherein A represents a substituted or unsubstituted alkyl group, a substituted or unsubstituted alkenyl group or a substituted or unsubstituted aryl group each containing from 8 to 25 carbon atoms; X represents —O—, $$-\underset{\underset{O}{\|}}{C}O-,$$

—S—, $$-\underset{\underset{R}{|}}{N}-,\quad -CO\underset{\underset{R}{|}}{N}-\quad \text{or}\quad -SO_2\underset{\underset{R}{|}}{N}-,$$

and R represents an alkyl group containing from 1 to 10 carbon atoms or a group -Y-B; Y represents a group containing at least $-(CH_2CH_2O)_a-$and $$-(CH_2\underset{\underset{OH}{|}}{C}HCH_2O)_b-,$$

wherein a is an integer from 5 to 50 and preferably from 5 to 20, and b is an integer from 2 to 20 and preferably from 2 to 10; and B represents hydrogen, an alkyl group containing at most 8 carbon atoms, or a phenyl group.

DETAILED DESCRIPTION OF THE INVENTION

Preferred examples of A include $C_8H_{17}$—, $C_{16}H33$—,

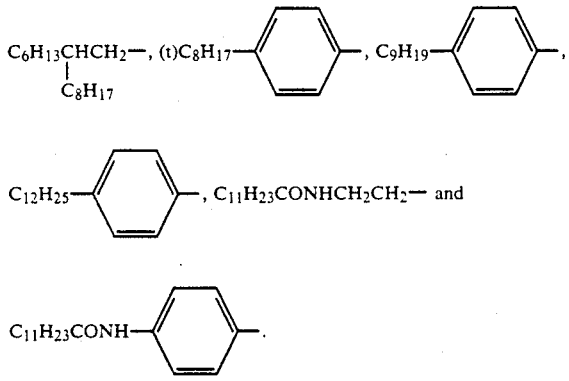

Actual preferred examples of Y include:

$$-(CH_2CH_2O)_{10}-(CH_2\underset{\underset{OH}{|}}{C}HCH_2O)_3-,$$

$$-(CH_2CH_2O)_{10}-(CH_2\underset{\underset{OH}{|}}{C}HCH_2O)_5-(CH_2CH_2O)_{10}-,$$

$$-(CH_2\underset{\underset{OH}{|}}{C}HCH_2O)_3-(CH_2CH_2O)_{10}-, \text{ and}$$

$$-(CH_2\underset{\underset{OH}{|}}{C}HCH_2O)_3-(CH_2CH_2O)_{20}-(CH_2\underset{\underset{OH}{|}}{C}HCH_2O)_3-.$$

Preferred examples of B includes H, $C_4H_9$—and

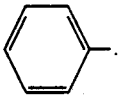
Examples of compounds of formula (I) which can be used in the invention are indicated below, but the invention is not to be construed as being limited to these compounds.
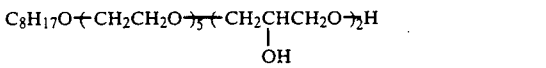
I-1
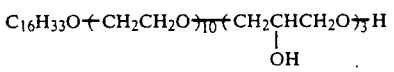
I-2
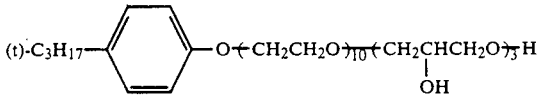
I-3
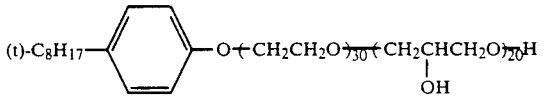
I-4
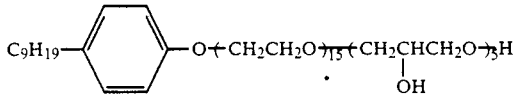
I-5
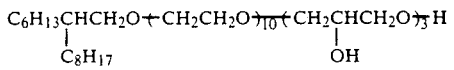
I-6
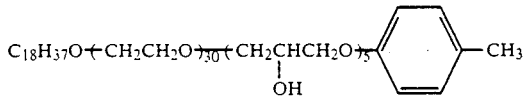
I-7
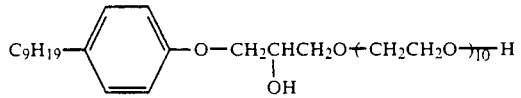
I-8
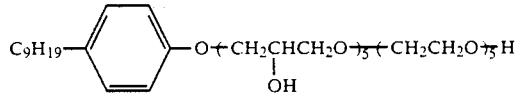
I-9
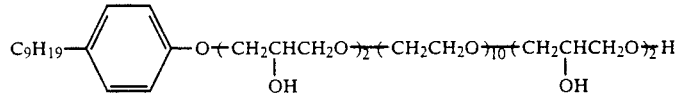
I-10
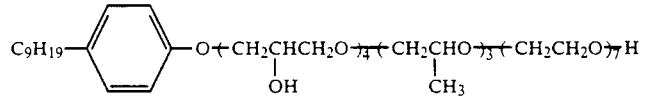
I-11
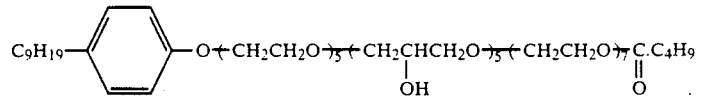
I-12
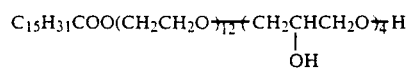
I-13
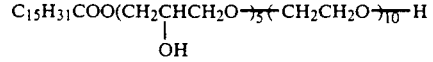
I-14

-continued $$C_{15}H_{31}COO(CH_2CH_2O)_7(CH_2\underset{\underset{OH}{|}}{C}HCH_2O)_7(CH_2CH_2O)_7C_8H_{17} \quad \text{I-15}$$

$$C_{12}H_{25}-S-(CH_2CH_2O)_{10}(CH_2\underset{\underset{OH}{|}}{C}HCH_2O)_5H \quad \text{I-16}$$

$$C_{14}H_{29}-N\begin{cases}(CH_2CH_2O)_a(CH_2\underset{\underset{OH}{|}}{C}HCH_2O)_cH \\ (CH_2CH_2O)_b(CH_2\underset{\underset{OH}{|}}{C}HCH_2O)_dH\end{cases} \quad \text{I-17}$$

a + b = 15 c + d = 5

$$C_{16}H_{33}CON\begin{cases}(CH_2CH_2O)_a(CH_2\underset{\underset{OH}{|}}{C}HCH_2O)_cH \\ (CH_2CH_2O)_b(CH_2\underset{\underset{OH}{|}}{C}HCH_2O)_dH\end{cases} \quad \text{I-18}$$

a + b = 20 c + d = 10

$$C_{12}H_{25}SO_2\underset{\underset{CH_3}{|}}{N}(CH_2CH_2O)_{20}(CH_2\underset{\underset{OH}{|}}{C}HCH_2O)_5H \quad \text{I-19}$$

In this invention, the compound represented by general formula [I] may be added to a hydrophilic organic colloid, or to an organic solvent based coating liquid for the support backing layer.

The compound represented by general formula [I] of this invention is included in at least one silver halide emulsion layer or other structural layer of the photographic material. In this context the other structural layer is preferably a hydrophilic colloid layer, for example, a surface protective layer, backing layer, intermediate layer or an under-layer. The most desirable layers for the addition are the surface protective layer and the backing layer.

In cases where the surface protective layer or the backing layer consists of two layers, the compound can be added to either layer, or it can be used in an overcoat layer over the surface protective layer.

The compound represented by general formula [I] used in the invention can be dissolved in water, or in an organic solvent such as methanol, isopropanol or acetone, or in a mixture of these solvents, the solution thus obtained is added to the coating liquid for the surface protective layer or the backing layer and then the coating liquid is coated by dip coating, air knife coating, spraying or using the extrusion coating method using a hopper as disclosed in U.S. Pat. No. 2,681,294 for application to the photographic material, and two or more layers can be coated at the same time using the methods disclosed, for example, in U.S. Pat. Nos. 3,508,947, 2,941,898 and 3,526,528, or it can be loaded in an anti-static fluid. Furthermore, an anti-static fluid (consisting of a simple solution or containing a binder) which contains a compound of this invention can also be coated on top of the protective layer, as required.

The amount of the compound represented by general formula [I] of this invention used ranges from 0.0001 to 2.0 grams, and preferably from 0.0005 to 0.3 grams, per square meter of photographic material.

Two or more compounds represented by the general formula [I] of this invention can be used together.

No particular limitation is imposed on the lubricant which is used in the invention, and any conventional compound can be used provided that it reduced the coefficient of friction of the surface of the material.

Typical examples of lubricant which can be used in the invention include the silicone based lubricant disclosed, for example, in U.S. Pat. No. 3,042,522, British Patent 955,061, U.S. Pat. Nos. 3,080,317, 4,004,927, 4,047,958 and 3,489,567, and British Patent 1,143,118; the higher fatty acid based, alcohol based and acid amide based lubricant disclosed, for example, in U.S. Pat. Nos. 2,454,043, 2,732,305, 2,976,148 and 3,206,311, and German Patents 1,284,295 and 1,284,294; the metal soaps disclosed, for example in British Patent 1,263,722 and U.S. Pat. No. 3,399,516; and the ester based and ether based lubricant disclosed in U.S. Pat. Nos. 2,588,765 and 3,121,060, and British Patent 1,198,387.

The use of the ester based lubricant represented by formulae [II], [III] and [IV] indicated below and the alkylpolysiloxanes represented by formulae [V], [VI] and [VII] is preferred in this invention.

Moreover, the use of the esters represented by formula [II] is most desirable.

Formula [II]

$$R_1-COO-R_2$$

In this formula, $R_1$ and $R_2$, which may be the same or different, each represents an alkyl group which has from 10 to 20 carbon atoms.

Formula [III]

$$\begin{array}{l} CH_2OCOR_3 \\ | \\ CHOCOR_4 \\ | \\ CH_2OCOR_5 \end{array}$$

In this formula, $R_3$, $R_4$ and $R_5$, which may be the same or different, each represents an alkyl group which has from 10 to 20 carbon atoms.

Formula [IV]

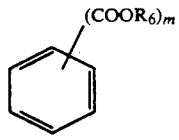

In this formula, $R_6$ represents an alkyl group which has from 10 to 24 carbon atoms, and m is an integer from 2 to 4. The $R_4$ groups may be the same or different.

Formula [V]

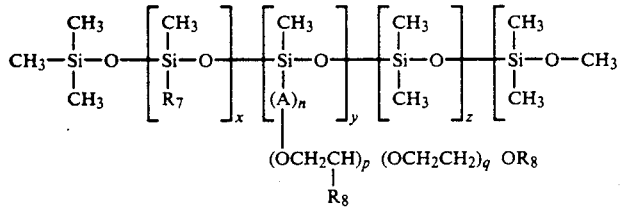

In this formula, $R_7$ represents an aliphatic group [for example, an alkyl group (which preferably has from 1 to 18 carbon atoms), a substituted alkyl group (for example, an aralkyl group, an alkoxyalkyl group or an aryloxyalkyl group)] or an aryl group (for example, phenyl). $R_8$ represents an alkyl group (for example, methyl), or an alkoxyalkyl group (for example, methoxymethyl). A represents a divalent aliphatic hydrocarbyl group. Moreover, n is 0 or an integer of 1 to 12, p is an integer from 0 to 50, q is an integer from 2 to 50, (preferably from 20 to 30), x is an integer from 0 to 100, y is an integer from 1 to 50 and z is an integer from 0 to 100, and x+y+z is an integer from 5 to 250 (and preferably from 10 to 50).

Formula [VI]

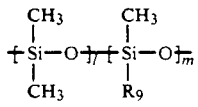

Formula [VI] includes cyclic siloxanes which have siloxane units which are represented by formula [VI-1] below and linear chain siloxanes which have a terminal group represented by Formula [VI-2].

General Formula [VI-1]

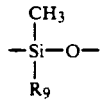

General Formula [VI-2]

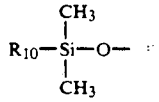

In these formulae, $R_9$ represents an alkyl group which has from 5 to 20 carbon atoms, a cycloalkyl group. an alkoxyalkyl group, an aralkyl group, an aryloxyalkyl group or a glycidyloxyalkyl group.

$R_{10}$ represents an alkyl group having from 1 to 20 carbon atoms, a cycloalkyl group having from 5 to 20 carbon atoms, an alkoxyalkyl group, an arylalkyl group, an aryloxyalkyl group or a glycidyloxyalkyl group.

Moreover, l is 0 or an integer from 1 or more, preferably from 1 to 1,000, m is an integer of value 1 or more, preferably 1 to 1,000, l+m is an integer from 1 to 1,000, and the value of l+m is preferably from 2 to 1,000, and more preferably from 2 to 500.

Formula [VII]

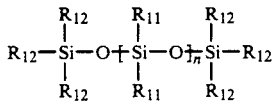

In this formula, $R_{11}$ represents an alkyl group which has from 1 to 3 carbon atoms and $R_{12}$ represents an alkyl group which has from 1 to 3 carbon atoms or an alkoxy group which has 1 or 2 carbon atoms. Moreover, n is an integer from 0 to 2000.

Typical illustrative compounds represented by formula [II] are indicated below, but the present invention is not to be construed as being limited thereto.

II-1

$(n)C_{15}H31COO—C_{16}H_{33}(n)$

II-2

$(n)C_{13}H_{27}COO—C_{14}H_{29}(n)$

II-3

$(n)C_{15}H_{31}COOC(CH_3)(CH_2)_{12}CH_3$

II-4

$(n)C_{13}H_{27}COOC_{20}H_{41}(n)$

II-5

$(n)C_{16}H_{33}COOC_{20}H_{41}(n)$

Typical illustrative compounds represented by Formula [III] are indicated below, but the present invention is not to be construed as being limited thereto.

$CH_2OCOC_{10}H_{21}(n)$
$CHOCOC_{10}H_{21}(n)$
$CH_2OCOC_{10}H_{21}(n)$ III-1

$CH_2OCOC_{11}H_{23}(n)$
$CHOCOC_{11}H_{23}(n)$
$CH_2OCOC_{11}H_{23}(n)$ III-2

-continued

III-3

$$\begin{array}{l} CH_2OCOC_{15}H_{31}(n) \\ | \\ CHOCOC_{15}H_{31}(n) \\ | \\ CH_2OCOC_{15}H_{31}(n) \end{array}$$

III-4

$$\begin{array}{l} CH_2OCOC_{14}H_{29}(n) \\ | \\ CHOCOC_{16}H_{33}(n) \\ | \\ CH_2OCOC_{18}H_{37}(n) \end{array}$$

Typical illustrative compounds represented by the general formula [IV] are indicated below, but the present invention is not to be construed as being limited thereto.

IV-1

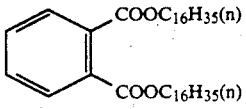

IV-2

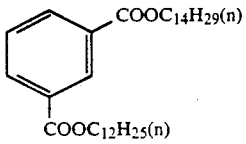

IV-1

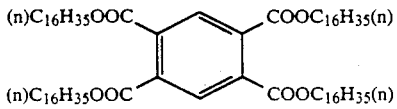

Typical illustrative compounds represented by the general formula [V] are indicated below, but the present invention is not to be construed as being limited thereto.

V-1

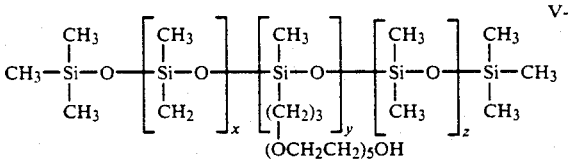

x + y + z = 30

V-2

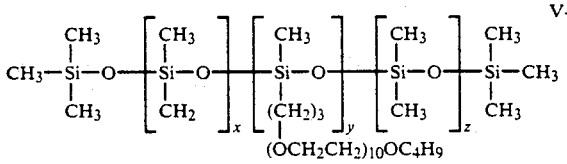

x + y + z = 40

V-3

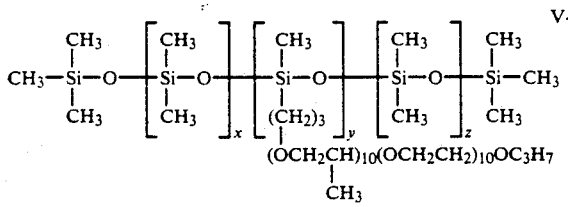

x + y + z = 35

-continued

V-4

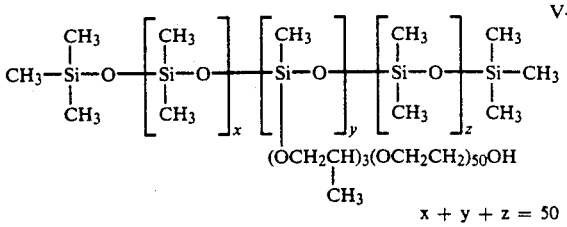

x + y + z = 50

V-5

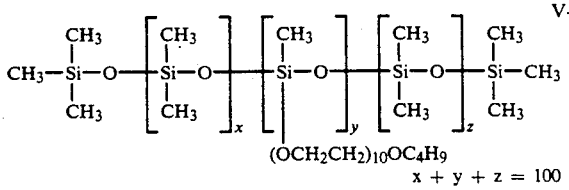

x + y + z = 100

V-6

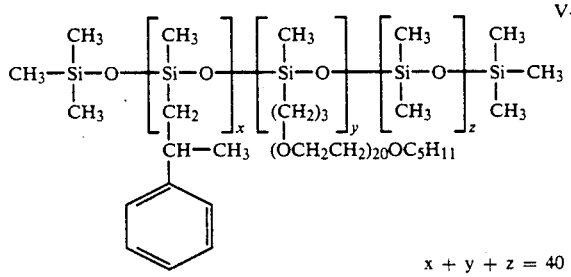

x + y + z = 40

V-7

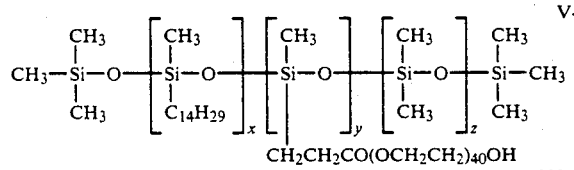

x + y + z = 200

V-8

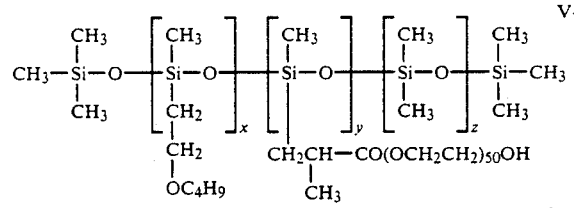

x + y + z = 35

V-9

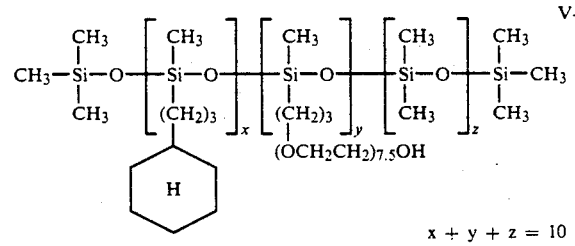

x + y + z = 10

V-10

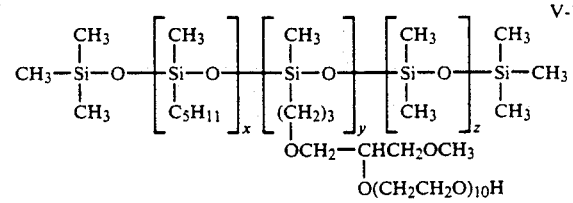

-continued
V-11
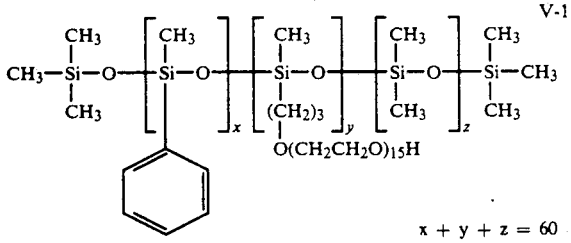
$x + y + z = 60$
Typical illustrative compounds represented by formula [VI] are indicated below, but the present invention is not to be construed as being limited thereto.
VI-1
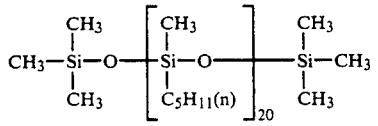
VI-2
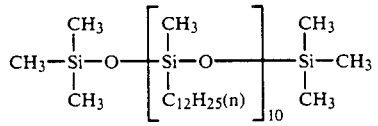
VI-3
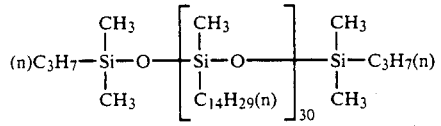
VI-4
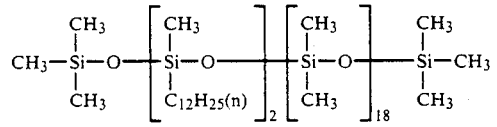
VI-5
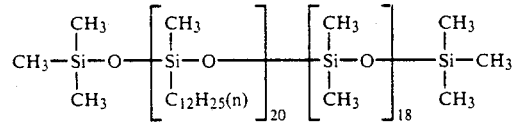
VI-6
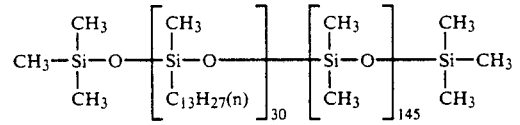
VI-7
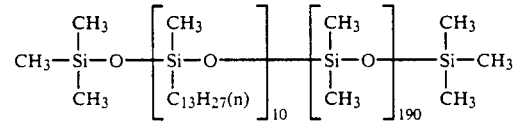
VI-8
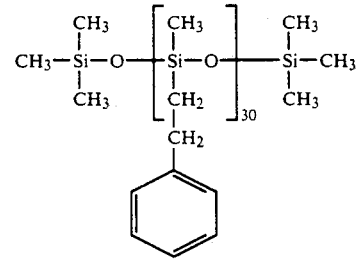

-continued
VI-9
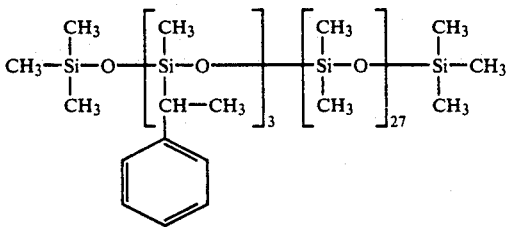
VI-10
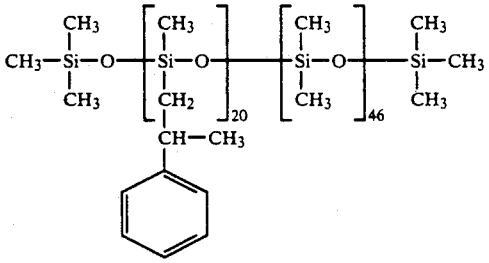
VI-11
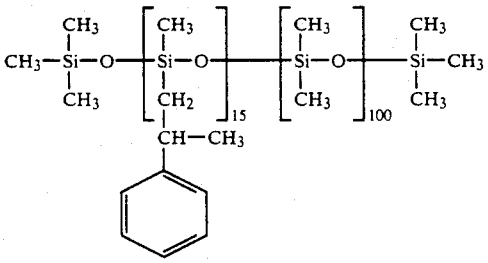
VI-12
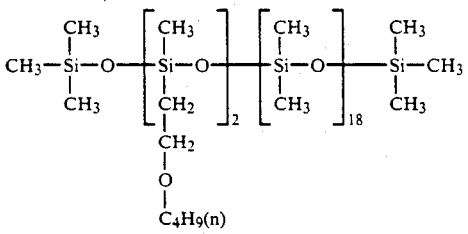
VI-13
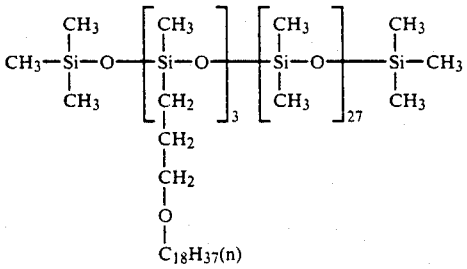
VI-14
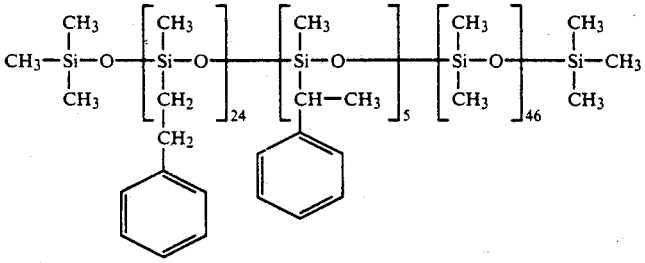

-continued

VI-15

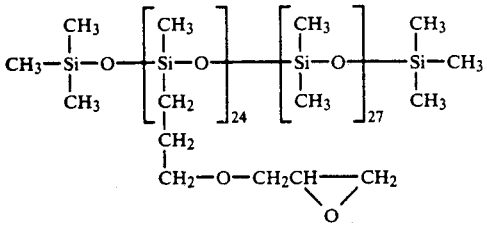

Cyclic Siloxane

VI-16

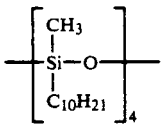

VI-17

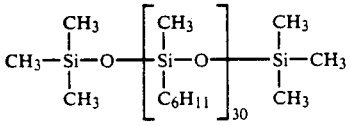

VI-18

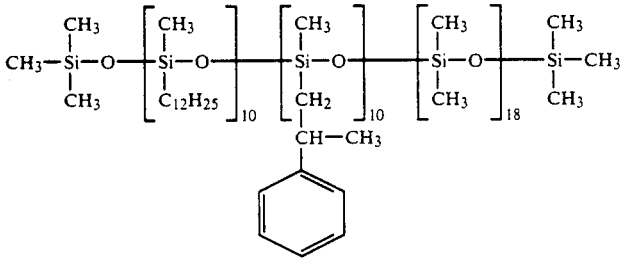

VI-19

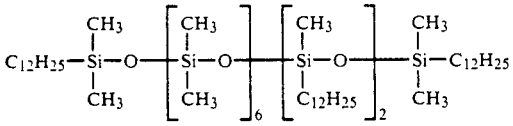

VI-20

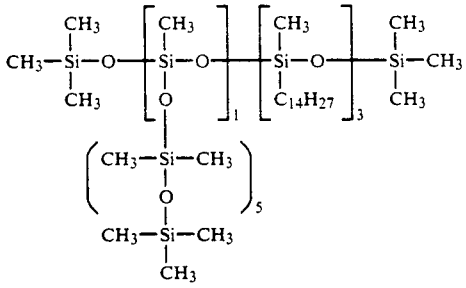

Typical illustrative compounds represented by formula [VII] are indicated below, but the present invention is not to be construed as being limited thereto.

VII-1

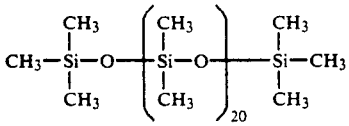

-continued

VII-2

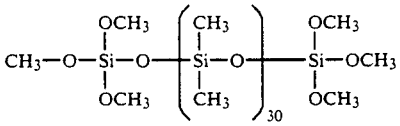

The lubricants used in the invention can be added by dispersion, preferably in a particle size of from 0.1 to 10 μm, in a hydrophilic colloid in the presence of a suitable dispersing agent using a desorption type emulsification and dispersion machine, or they may be added directly, or in the form of a diluted solution in a suitable organic solvent, to the coating liquid. Although the lubricants used in the invention can also be used in combinations without limit, a combination of the compound of formula [I] and lubricant represented by formula [II], [III], [IV], [V], [VI] or [VII] is preferable and a combination of the compound of formula [I] and lubricant of formula [II], [III], [V], or [VI] is more preferable.

The amount of the lubricant used is preferably from 0.0001 to 2.0 grams, and most preferably from 0.005 to 0.2 gram, per square meter of the photographic material.

The photographic materials in this invention may be, for example, conventional black and white silver halide photographic materials (for example, black and white camera film, black and white sensitive materials for X-ray purposes, and black and white sensitive materials for printing purposes), or conventional multi-layer color photosensitive materials (for example, color negative films, color reversal films, color positive films, and color negative films for cinematographic purposes), or sensitive materials for use with infrared light in laser scanners.

The silver halide grains in the photographic emulsion may have a regular crystal form such as cubic, octahedral or tetradechedral crystal form, or an irregular crystal form such as spherical or tabular crystal form, or a composite form of these crystal forms.

Further, tabular grains having an aspect ratio of about 5 or more may also be used as is described in *Research Disclosure (RD)* Vol. 225, pages 20 to 58 (January 1983).

The crystal structure of the silver halide grains may have an epitaxial structure or may have multi-layered structure in which the inside part and the outside part of one grain may have different compositions, for example, different halogen compositions.

The grain size distribution may be broad or narrow. The latter is known as a so-called monodispered emulsion. The monodispersed silver halide emulsion having a variation coefficient (which refers to the value obtained by dividing the standard deviation in the granularity distribution curve of the silver halide emulsions by the mean grain size) not exceeding 20%, more preferably 15% or less, is preferred for use in the photosensitive material employed in the present invention.

The silver halide photographic emulsions to be used in the present invention can be prepared, for example, by the methods described in P. Glafkides, *Chemie et Phisiquie Photoqraphique* (published by Paul Montel, 1967); G. F. Duffin, *Photographic Emulsion Chemistry* (published by Focal Press, 1966); V. L. Zelikma et al, *Making and Coating Photographic Emulsion* (published by Focal Press, 1964), etc.

Any of silver halides prepared by a neutral process, an ammoniacal process and an acidic process may be used. One side mixing method, a simultaneous mixing method or any combination thereof may be used to react the soluble silver salts and the soluble halogen salts.

Any of silver halide to be used in the photographic emulsion such as silver iodide, silver iodobromide, silver chloroiodobromide, silver chloroiodide or a combination thereof may be used.

Proteins such as gelatin and casein, cellulose derivatives such as carboxymethylcellulose and hydroxyethylcellulose, sugar derivatives such as agar, dextran, sodium alginate and starch derivatives, synthetic hydrophilic colloids, for example, poly(vinyl alcohol), poly(N-vinylpyrrolidone), poly(acrylic acid) copolymers, polyacrylamides and derivatives and partial hydrolyzates thereof, can be used as the binder for the emulsion layers and other layers of the silver halide photographic materials of this invention. The binder is used in an amount of from 0.05 g to 50 g per square meter of the sensitive material.

The term "gelatin" as used herein includes lime treated gelatins, acid treated gelatins, and enzyme treated gelatins.

Furthermore, the photographic materials of this invention can contain in the photographic structural layers an alkyl acrylate based latex as disclosed, for example, in U.S. Pat. Nos. 3,411,911 and 3,411,912, and JP-B-45-5331. (The term "JP-B" as used herein means an "examined Japanese patent publication".)

The emulsions which are used in the photosensitive silver halide emulsion layers of this invention are preferably chemically sensitized emulsions.

Chemical sensitization can be carried out using the methods described by Glafkides and Zelikman, and in *Die Grundlagen der Photoqraphischen Prozesse mit Silberhaloqeniden,* edited by H. Frieser (Akademische Verlagsgesellschaft, 1968).

That is to say, use can be made of sulfur sensitization methods in which active gelatin or compounds which contain sulfur which can react with silver ions are used, reduction sensitization methods in which reducing substances are used, and precious metal sensitization methods in which gold and other precious metal compounds are used, and these methods may be used independently or in combinations. Sulfur sensitizing agents which can be used include thiosulfates, thioureas, thiazoles, rhodanines and other compounds. Stannous salts, amines, hydrazine derivatives, formamidinesulfinic acid and silane compounds, for example, can be used as reducing agents, and complex salts of metals of group VIII of the periodic table, such as platinum, iridium and palladium, can be used as well as gold complex salts for precious metal sensitization.

Various compounds can be included as stabilizers in the photographic materials of this invention. Thus many compounds which are known as stabilizers, including azoles, for example, benzothiazolium salts, nitroindazoles, triazoles, benzotriazoles, benzimidazoles (for example, nitro or halogen substituted benzimidazoles); heterocyclic mercapto compounds, for example, mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; heterocyclic mercapto compounds as mentioned above which have water solubilizing groups such as carboxyl groups and sulfo groups; thioketo compounds, for example, oxazolinethione; azaindenes, for example, tetra-azaindenes (especially 4-hydroxy substituted (1,3,3a,7)tetraazaindenes); benzenethiosulfonic acid; and benzenesulfinic acid, can be added for this purpose.

Surfactants can be included in the photographic emulsion layers and other structural layers of the photosensitive materials of this invention for various purposes, for example, as coating aids, as antistatic agents, for improving slip properties, for emulsification and dispersion purposes, to prevent sticking, and for improving photographic characteristics (for example, for accelerating development, increasing contrast, and increasing speed).

For example, use can be made of non-ionic surfactants such as saponin (steroid based), alkyleneoxide derivatives (for example, polyethyleneglycol, polyethyleneglycol/polypropyleneglycol condensates, polyethyleneglycol alkyl ethers or polyethyleneglycol alkyl aryl ethers, polyethyleneglycol esters, polyethyleneglycol sorbitane esters, polyalkyleneglycol alkylamides or amides, and polyethyleneoxide adducts of silicones), glycidol derivatives (for example, alkenylsuccinic acid polyglyceride and alkylphenol polyglyceride), fatty acid esters of polyhydric alcohols and sugar alkyl esters; anionic surfactants which contain acid groups, such as carboxyl groups, sulfo groups, phospho groups, sulfate ester groups, phosphate ester groups, for example, alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinic acid esters, sulfoalkylpolyoxyethylenealkylphenyl ethers and polyoxyethylenealkyl phosphate esters; amphoteric surfactants such as amino acids, aminoalkylsulfonic acids, aminoalkyl sulfate or phosphate esters, alkylbetaines and amine oxides; and cationic surfactants, such as alkylamines, aliphatic or aromatic quaternary ammonium salts, heterocyclic quaternary ammonium salts such as pyridinium salts and imidazolium salts, and sulfonium or phosphonium salts which contain an aliphatic or heterocyclic ring. The use of the polyoxyethylene based surfactants from among these surfactants, and of fluorine based surfactants, is especially desirable. The polyoxyethylene based surfactants of this invention are preferably added to the photosensitive emulsion layers of the photographic material, but they can be added to non-photosensitive layers.

Polymeric hardening agents which are fast to diffusion as disclosed, for example, in JP-A-56-142524, and low molecular weight hardening agents such as those indicated below can be used as hardening agents. Typical examples include mucochloric acid, mucobromic acid, formaldehyde, dimethylolurea, trimethylolmelamine, glyoxal, 2,3-dihydroxy-5-methyl 1,4-dioxane and aldehydes such as glutaraldehyde; active vinyl compounds such as divinylsulfone, methylenebismaleimide, 5-acetyl-1,3-diacryloyl-hexahydro- s-triazine, 1,3,5-triacryloylhexahydro-s-triazine, 1,3,5-trivinylsulfonyl-hexahydro-s-triazine, bis(vinylsulfonylmethyl)ether, 1,3-bis(vinylsulfonyl)-2-propanol and 1,3-bis(vinylsulfonylacetylamido)propane; active halogen compounds such as 2,4-dichloro-6-hydroxy-s-triazine.sodium salt, 2,4-dichloro-6-methoxy-s-triazine, 2,4-dichloro-6-(4-sulfoanilion)-S-triazine.sodium salt, 2,4-dichloro-6-(2-sulfoethylamino)-s-triazine and N,N'-bis(2-chloroethylcarbamoyl)piperazine; epoxy based compounds such as bis(2,3-epoxypropyl)methylpropylammonium p-toluenesulfonate; ethylimine based compounds such as 2,4,6-triethylimino-s-triazine, methanesulfonic acid ester based compounds such as 1,2-di(methanesulfoxy)ethane; carbodiimido compounds such as dicyclohexylcarbondiimide; iso-oxazole based compounds such as 2,5-dimethylisooxazole perchlorate; and inorganic based compounds such as chrome alum and chromium acetate.

Among these compounds, those which have a vinylsulfone group and the active halogen compounds are preferred.

The photographic emulsions used in the invention can be spectrally sensitized with methine dyes or by other means. The dyes which can be used for this purpose include cyanine dyes, merocyanine dyes, complex cyanine dyes, complex merocyanine dyes, holopolar hemioxonol dyes. Dyes from among the cyanine dyes, merocyanine dyes and complex merocyanine dyes are especially useful. These dyes may have any of the nuclei normally used in cyanine dyes as the basic heterocyclic nucleus. That is to say, a pyrroline nucleus, oxazoline nucleus, thiazoline nucleus, pyrrole nucleus, oxazole nucleus, thiazole nucleus, selenazole nucleus, imidazole nucleus, tetrazole nucleus or a pyridine nucleus, a nucleus obtained by condensing an aliphatic hydrocarbyl ring with these nuclei, or a nucleus obtained by condensing an aromatic hydrocarbyl ring with these nuclei, for example an indolenine nucleus, benzindoledine nucleus, indole nucleus, benzoxazole oxazolenucleus, naphthoxazole nucleus, benzothiazole nucleus, naphthothiazole nucleus, benzoselenazole nucleus, benzimidazole nucleus or a quinoline nucleus can be used. These nuclei may also be substituted on the carbon atoms.

Five or six-membered heterocyclic nuclei, such as the pyrazolin-5-one nucleus, the thiohydantoin nucleus, the 2-thiooxazolidin-2,4 dione nucleus, the thiazolidin-2,4-dione nucleus, the rhodanine nucleus and the thiobarbituric acid nucleus, can be used as the nucleus which has a ketomethylene structure in the merocyanine dyes and complex merocyanine dyes.

The amount of sensitizing dye used in the invention is preferably within the range from $1\times10^{-6}$ to $5\times10^{-3}$ mol per mol of silver in total contained in the sensitive material.

Colored image forming couplers, which is to say compounds (referred to below as couplers) which react with the oxidized form of an aromatic amine (normally a primary amine) developing agent to form a dye can also be included in the photographic emulsions of this invention. The couplers are preferably non-diffusible, having hydrophobic groups known as ballast groups in the molecule. The couplers may be either four-equivalent or two-equivalent with respect to silver ions. Moreover, colored couplers which have a color correcting effect, or couplers (known as DIR couplers) which release a development inhibitor as development proceeds, can also be included. These couplers may also be couplers of which the products of the coupling reaction are colorless.

The known open chain ketomethylene based couplers can be used as yellow color forming couplers. Among these couplers the benzoylacetanilide based compounds and pivaloylacetanilide based compounds are useful.

Pyrazolone compounds, indazolone based compounds and cyanoacetyl compounds can be used, for example, as magenta couplers, and the pyrazolone based compounds are especially useful.

Phenol based compounds and naphthol based compounds, for example, can be used as cyan couplers.

The protective layer of a silver halide photographic material of this invention is a layer consisting of a hydrophilic colloid, and the hydrophilic colloids described earlier can be used for this purpose. Furthermore, the protective layer may consist of a single layer or a multi-layer.

Matting agents and or smoothing agents than the lubricants of the present invention, especially the lubricants represented by formulae (II), (III), (IV), (V), (VI) and (VII) can be added to the emulsion layers or protective layers, and preferably to the protective layers, of silver halide photographic materials of this invention. Organic compounds, for example water dispersible vinyl polymers such as poly(methyl methacrylate), or inorganic compounds, such as a silver halide, strontium/barium sulfate, of an appropriate particle size (those of a particle size within the range from 0.3 to 5 μm, or of at least twice, and preferably at least four times, the thickness of the protective layer) are preferred for use as a matting agent. The smoothing agents, as well as having an anti-stick function similar to that of the matting agents, also have the effect of improving the friction characteristics in connection with camera compatibility, especially when taking pictures on film for cinematographic purposes and projecting these films, and in practical terms liquid paraffin, waxes such as higher aliphatic acid esters, polyfluorinated hydrocarbons and derivatives thereof, and siloxanes, such as polyalkylpolysiloxane, polyarylpolysiloxane, polyalkylarylpolysiloxane, and alkyleneoxide adducts of these compounds are preferred for use in this connection.

Intermediate layers and filter layers, for example, can be provided, as required, in the silver halide photographic materials of this invention.

In practice, the silver halide photographic materials of this invention can be used, for example, as X-ray photosensitive materials, photosensitive lith materials, black and white camera sensitive materials, color negative photosensitive materials, color reversal photosensitive materials and color printing papers.

Various other conventional additives can be used, as required, in the photographic materials of this invention. For example, use can be made of development accelerators, fluorescent whiteners, anti-color fogging agents and ultraviolet absorbers. Specifically, use can be made of the additives disclosed on pages 28 to 30 of *Research Disclosure* No. 176 (RD-17643, 1978).

Furthermore, pages 28 to 30 of RD-17643 disclose methods for the development processing of the photosensitive materials of this invention.

The compounds represented by formula [I] used in the present invention are synthesized by a well known method. The synthetic example producing the compound of formula [I] is indicated below.

Synthesis Example I (Synthesis of compound I-3)

In a 300 ml-volume three necked flask equipped with a stirrer, a condensor, a thermometer and a funnel were charged 97.0 g (0.15 mol) of dried

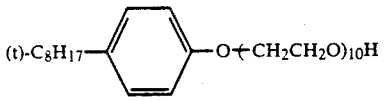

and 3.9 g of NaOH.

The mixture was heated to a temperature of 155° to 160° C. with stirring.

Maintaining the inside temperature at 155° to 160° C., 33.3 g (0.45 mol) of glycidol was added thereto dropwise over a period of 1.5 hours. The stirring was continued for an additional 7 hours at 160° C. There was no unreacted glycidol.

After cooling, 100 ml of ethanol was added to dissolve the mixture and neutralized with a conc. hydrochloric acid. After the solvent was distilled away under reduced pressure, 200 ml of toluene was added to dissolve the mixture again. The mixture was decolorized using an active carbon with heating, separated by filtration and vacuum distilled to obtain light-yellow viscous liquid.

It was confirmed by IR analysis and NMR analysis that the compound thus obtained was the compound (I-3) which contains partly a reaction product with a secondary hydroxyl group produced in a reaction with glycidol.

The surface tension (1%) was dyn/cm.

EXAMPLES

The invention is now described in greater detail with reference to specific examples, but the invention is not to be construed as being limited to these examples. Unless otherwise indicated, all parts, percents and ratios are by weight.

EXAMPLE 1

(1) Preparation of the Photosensitive Silver Halide Emulsion Layer

A container containing 25 grams of potassium bromide, 15 grams of potassium iodide, 1.9 grams of potassium thiocyanate and 24 grams of gelatin in 1 liter of water was maintained at a temperature of 60° C. and stirred vigorously while 900 ml of an aqueous solution of silver nitrate (1M) and 900 ml of an aqueous solution of potassium bromide (1M) were added using a double jet system with a conventional ammonia method, and a silver iodobromide emulsion with an iodide content of 10 mol% consisting of tabular grains of irregular form of average grain size 1.0 μm was prepared. Subsequently, 230 mg of dye A was added and then chemical sensitization was carried out using sodium thiosulfate and chloroauric acid to provide photosensitive silver iodobromide emulsion (A). Photosensitive silver iodobromide emulsion (B) with an average iodide content of 6 mol% and an average grain size of 0.6 m was prepared in the same way as emulsion (A) except that the amount of potassium iodide used initially was 9 grams and the temperature was 40° C.

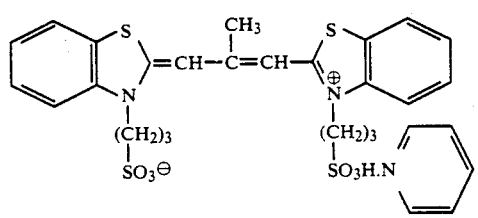

Dye A

Preparation of Coated Samples

A triacetylcellulose support of which the emulsion coating side had been coated with an subbing-layer and on which the following layer was coated on the back surface was used for the support.

Backing Layer 10 mg/m²

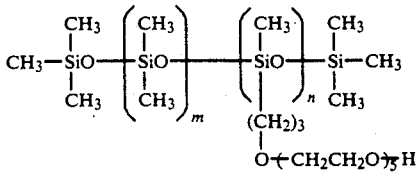

m + n = 32

-continued

| Backing Layer | |
|---|---|
| 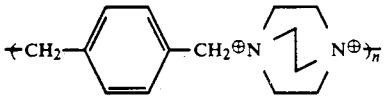 | 60 mg/m$^2$ |
| $2Cl^{\ominus}$ ($n \approx 20$) | |
| Diacetylcellulose | 143 mg/m$^2$ |
| Silicon oxide | 5 mg/m$^2$ |

Coated samples 1 to 9 were prepared by coating the layers having the formulations indicated below on the emulsion coating side of the support.

| | |
|---|---|
| First Layer | |
| Gelatin | 0.6 g/m$^2$ |
| 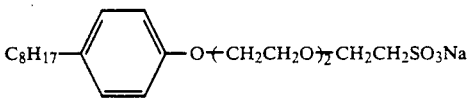 | 3.6 mg/m$^2$ |
| Poly(potassium p-vinylbenzenesulfonate) (molecular weight about 1,000,000) | 9 mg/m$^2$ |
| Second Layer | |
| Gelatin | 1.0 g/m$^2$ |
| 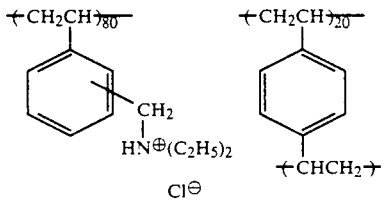 | 175 mg/m$^2$ |
| 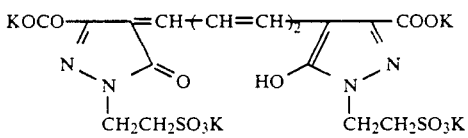 | 26 mg/m$^2$ |
| 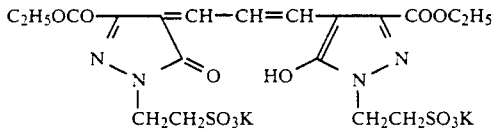 | 16 mg/m$^2$ |
| 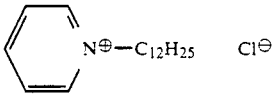 | 15 mg/m$^2$ |
| HCl | 0.11 mg/m$^2$ |
| Third Layer | |
| Gelatin | 0.4 mg/m$^2$ |
| Poly(potassium p-vinylbenzenesulfonate) (molecular weight about 1,000,000) | 5 mg/m$^2$ |
| Fourth Layer (Emulsion Layer) | |
| Emulsion (B) was used. | |
| Coated silver weight | 1.36 g/m$^2$ |
| Amount of gelatin | 2.0 g/m$^2$ |
| 4-Hydroxy-6-methyl-1,3,3a,7-tetraazaindene | 30 mg/m$^2$ |
| $C_{18}H_{35}O(CH_2CH_2O)_{25}H$ | 7 mg/m$^2$ |
| 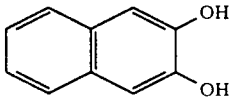 | 1.5 mg/m$^2$ |
| Poly(potassium p-vinylbenzenesulfonate) | 50 mg/m$^2$ |
| Bis(vinylsulfonylacetamido)ethane | 57 mg/m$^2$ |
| Fifth Layer (Emulsion Layer) | |
| Emulsion (A) was used. | |
| Coated silver weight | 4.2 g/m$^2$ |
| Amount of gelatin | 5.5 g/m$^2$ |
| Dextran (average molwt. 150,000) | 1.8 g/m$^2$ |

-continued

| | |
|---|---|
| Poly(acrylic acid)(molecular weight about 10,000) | 54 mg/m$^2$ |
| 4-Hydroxy-6-methyl-1,3,3a-7-tettraazaindene | 41 mg/m$^2$ |
| $C_{18}H_{35}O(CH_2CH_2O)_{25}H$ | 23 mg/m$^2$ |
| $CH_3CH_2C(CH_2OH)_3$ | 390 mg/m$^2$ |
| Poly(potassium p-vinylbenzenesulfonate) (molecular weightabout 1,000,000) | 88 mg/m$^2$ |
| Sixth Layer (Surface Protective Layer) | |
| Gelatin | 0.8 g/m$^2$ |
| 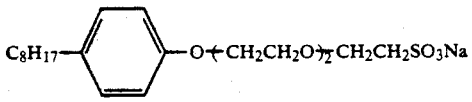 | 13 mg/m$^2$ |
| 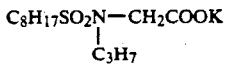 | 1.8 mg/m$^2$ |
| Poly(potassium p-vinylbenzenesulfonate) (molecular weight about 1,000,000) | 6 mg/m$^2$ |
| Fine poly(methyl methacrylate)particles (average particle size: 3 μm) | 0.13 mg/m$^2$ |
| Compound-X | |
| 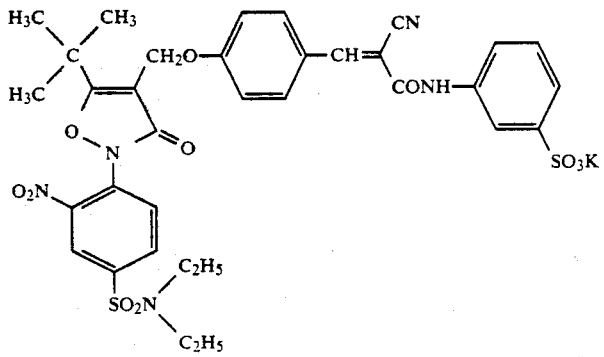 | 0.1 mg/m$^2$ |

Compound X was formed into a gelatin dispersion using the following procedure and supplied for coating. A solution obtained by dissolving 4.9 grams of compound X in 39 ml of methylethyl ketone was mixed, with stirring, with 260 grams of a 5.0% (by weight) aqueous gelatin solution at 45° C. and slightly emulsified to provide a dispersion.

And the compounds shown in Table 1.

(3) Evaluation of Photographic Characteristics

Evaluation of Damage Resistance

The samples were stored for 7 days after coating under conditions of 25° C., 65% RH. Each sample was then exposed uniformly in such a way as to provide an optical density, after development, of about fog density +1.0 using a light source which had a wavelength distribution corresponding to sunlight. The exposed samples and unexposed samples were left for 2 hours under conditions of 25° C., 50% RH, after which a sapphire needle of diameter 0.1 mm was rubbed at a rate of 60 cm/min over the samples under a load of 50 grams. None of the coated structural layers of the coated samples in this example was damaged. Each sample was then developed for 7 minutes at 20° C. using development bath A, after which they were fixed, washed and dried. The width over which the density changed on the rubbed part was measured for each exposed and unexposed sample using a microdensitometer with a 50 μm aperture, and the resistance to damage was evaluated in this way.

| Development Bath A | |
|---|---|
| Metol | 3 g |
| Anhydrous sodium sulfite | 100 g |
| Hydroquinone | 7.5 g |
| Borax | 2 g |
| Water | to make up to 1 liter |

Evaluation of Slip Properties

Each sample was moisture equilibrated for 2 hours at 25° C., 55% RH, after which a load of 100 grams was applied to a needle with a steel ball of diameter 5 mm attached to the tip and the coefficient of kinetic friction was determined on sliding the needle at a speed of 10 m/min over the sample surface.

Evaluation of Droplet Marks

Each sample was exposed in such a way as to provide a density, after development, of 1.0, and 20 samples measuring 36 mm×1.6 meters were developed, fixed, washed and dried using a roller transport type automatic processor.

The state of droplet marks on the twentieth strip of each processed sample was evaluated on the following basis in a functional evaluation.

0: Hardly any droplet marks to be seen.

Δ: Slight droplet marks can be seen.

x: Droplet marks observed.

Moreover, the processing operation in the automatic processor was as indicated below.

| | Processing Bath | Temp. (°C.) | Time (min.) |
|---|---|---|---|
| Development | HPD (made by the Fuji Photo Film Co.) | 26.5 | 1 |
| Fixing | Super Fujifix DPII (made by Fuji Photo Film Co.) | 26.5 | 2 |
| Washing | Running water | 20 | 2 |
| Drying | | 50 | 1.5 |

The results obtained are summarized in Table 1.

TABLE 1

| Sample | Slip Agent (Amount Added) | Compound of Formula (I) (Amount Added) | Resistance to Damage | | Sip Properties (Coefficient of Friction) | Droplet Marks |
|---|---|---|---|---|---|---|
| | | | Fog Area | Fog + 1.0 Area | | |
| 1 (Comparative Example) | None | None | 2.0 | 2.3 | 0.42 | O |
| 2 (Comparative Example) | II-1 (50 mg/m$^2$) | None | 0.6 | 0.8 | 1.18 | X |
| 3 (Comparative Example) | III-1 (50 mg/m$^2$) | None | 0.6 | 0.7 | 0.19 | X |
| 4 (Comparative Example) | V-10 (50 mg/m$^2$) | None | 0.9 | 0.9 | 0.22 | X |
| 5 (Comparative Example) | VI-10 (50 mg/m$^2$) | None | 0.8 | 0.9 | 0.22 | X |
| 6 (Invention) | II-1 (50 mg/m$^2$) | I-1 (50 mg/m$^2$) | 0.6 | 0.8 | 0.18 | O |
| 7 (Invention) | III-1 (50 mg/m$^2$) | I-1 (50 mg/m$^2$) | 0.6 | 0.8 | 0.19 | O |
| 8 (Invention) | V-10 (50 mg/m$^2$) | I-1 (50 mg/m$^2$) | 1.2 | 1.3 | 0.23 | O |
| 9 (Invention) | VI-10 (50 mg/m$^2$) | I-1 (50 mg/m$^2$) | 1.3 | 1.4 | 0.22 | O |

It is clear from the results shown in Table 1 that Samples 6 to 9 of this invention had excellent damage resistance, slip properties and showed little sign of droplet mark formation.

EXAMPLE 2

Samples 10 to 16 were prepared in the same way as in Example 1 except that the layer to which the compound represented by Formula [I] was added was varied.

The results obtained are summarized in Table 2.

It is clear from Table 2 that the compounds of this invention provided an improvement in respect of droplet marks, irrespective of the layer to which they were added, but that addition to the uppermost layer is desirable.

TABLE 2

| Sample | Slip Agent (Amount Added) | Compound of Formula (I) (Amound Added) | Layer to which the Compound of Formula (I) was Added | Slip Properties (Coefficient Friction) | Droplet Marks |
|---|---|---|---|---|---|
| 10 (Comparative Example) | II-1 (50 mg/m$^2$) | None | — | 0.18 | X |
| 11 (Invention) | II-1 (50 mg/m$^2$) | I-1 (50 mg/m$^2$) | Sixth Layer (Uppermost Layer) | 0.18 | O |
| 12 (Invention) | II-1 (50 mg/m$^2$) | I-1 (50 mg/m$^2$) | Fifth Layer | 0.18 | O |
| 13 (Invention) | II-1 (50 mg/m$^2$) | I-1 (50 mg/m$^2$) | Fourth Layer | 0.18 | O |
| 14 (Invention) | II-1 (50 mg/m$^2$) | I-1 | Third Layer | 0.17 | Δ |
| 15 (Invention) | II-1 (50 mg/m$^2$) | I-1 | Second Layer | 0.17 | Δ |
| 16 (Invention) | II-1 (50 mg/m$^2$) | I-1 | First Layer (Lowermost Layer) | 0.17 | Δ |

EXAMPLE 3

(1) Preparation of a Tabular Silver Halide Emulsion of Mean Aspect Ratio 12.0

Five percent of 900 ml of aqueous silver nitrate solution (1M) and aqueous potassium bromide solution were added using the double jet method to a container which contained 5 grams of potassium bromide and 30 grams of gelatin in 1 liter of water, while maintaining a pAg value of 9.5, after which a further 5% of the full amount of the aqueous silver nitrate solution was added using the single jet method. Then 85% of the aqueous silver nitrate solution and an aqueous potassium bromide and potassium iodide mixed solution were added while maintaining a pAg value of 9.0 to provide tabular grains which had an iodide content of 10 mol%. The remaining 5% of the aqueous silver nitrate solution and an aqueous solution of potassium bromide with a high concentration of potassium iodide were then added while maintaining a pAg value of 7.5, and a tabular silver iodobromide emulsion of average projected area diameter 2.2 μm, standard deviation 22%, aspect ratio 12.0 and iodide content 12 mol% was obtained. This emulsion was chemically sensitized using sodium thiosulfate and chloroauric acid, and photosensitive emulsion (C) of pAg 8.6, pH 6.4 was obtained.

(2Preparation of Coated Samples

Coated samples 17 to 28 were prepared by coating the layers having the formulations indicated below from the support side onto a triacetylcellulose support on which an subbing-layer had been established.

| | |
|---|---|
| First Layer (Emulsion Layer) | |
| Emulsion (B) from Example 1 was used. | |
| Coated silver weight | 2.8 g/m$^2$ |
| Amount of gelatin | 4.0 g/m$^2$ |
| 4-Hydroxy-6-methyl-1,3,3a,7-tetraazaindene | 60 mg/m$^2$ |
| $C_{18}H_{35}(CH_2CH_2O)_{25}H$ | 14 mg/m$^2$ |
| 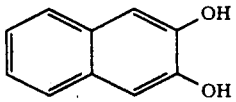 | 3.0 mg/m$^2$ |
| Poly(potassium p-vinylbenzenesulfonate) (molecular weight about 1,000,000) | 50 mg/m$^2$ |
| Bis(vinylsulfonylacetamido)ethane | 50 mg/m$^2$ |
| Second Layer (Emulsion Layer) | |
| Emulsion (C) was used. | |
| Amount of silver coated | 3.3 g/m$^2$ |
| Amount of gelatin | 6.0 g/m$^2$ |
| 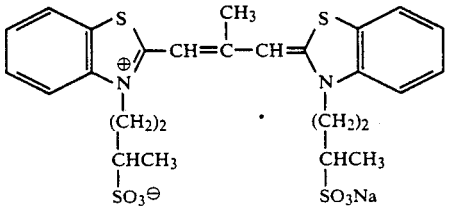 | 8.0 mg/m$^2$ |
| 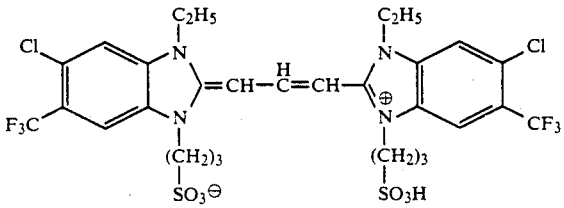 | 4.2 mg/m$^2$ |
| $C_{18}H_{35}(CH_2CH_2O)_{25}H$ | 30 mg/m$^2$ |
| $CH_3CH_2C(CH_2OH)_3$ | 350 mg/m$^2$ |
| Poly(potassium p-vinylbenzenesulfonate (molecular weight about 1,000,000) | 85 mg/m$^2$ |
| Third Layer (Surface Protective Layer) | |
| Same as the sixth layer in Example 1. | |

(3) Evaluation of Photographic Characteristics

These were evaluated in the same way as in Example 1.

The results obtained are summarized in Table 3.

It is clear from Table 3 that Samples 20 to 24 of this invention had excellent slip properties and damage resistance and showed little sign of droplet mark formation.

TABLE 3

| Sample | Slip Agent (Amount Added) | Compound of Formula (I) (Amound Added) | Resistance To Damage Fog Area | Resistance To Damage Fog + 1.0 Area | Sip Properties (Coefficient of Friction) | Droplet Marks |
|---|---|---|---|---|---|---|
| 17 (Comparative Example) | None | None | 2.5 | 2.6 | 0.43 | O |
| 18 (Comparative Example) | II-1 (50 mg/m$^2$) | None | 0.9 | 1.2 | 0.18 | X |
| 19 (Comparative Example) | None | I-2 (50 mg/m$^2$) | 2.5 | 2.5 | 0.42 | O |
| 20 | II-1 | I-2 | 0.9 | 1.2 | 0.18 | O |

TABLE 3-continued

| Sample | Slip Agent (Amount Added) | Compound of Formula (I) (Amound Added) | Resistance To Damage Fog Area | Fog + 1.0 Area | Sip Properties (Coefficient of Friction) | Droplet Marks |
|---|---|---|---|---|---|---|
| (Invention) 21 | (50 mg/m$^2$) II-1 | (50 mg/m$^2$) I-4 | 1.1 | 1.3 | 0.17 | O |
| (Invention) 22 | (50 mg/m$^2$) II-1 | (50 mg/m$^2$) I-9 | 1.0 | 1.2 | 0.19 | O |
| (Invention) 23 | (50 mg/m$^2$) II-1 | (50 mg/m$^2$) I-11 | 1.1 | 1.3 | 0.18 | O |
| (Invention) 24 | (50 mg/m$^2$) II-1 | (50 mg/m$^2$) I-18 | 1.1 | 1.2 | 0.18 | O |
| (Invention) 25 | (50 mg/m$^2$) II-1 | (50 mg/m$^2$) Comparative | 1.0 | 1.2 | 0.19 | X |
| (Comparative Example) 26 | (50 mg/m$^2$) II-1 | Compound A (50 mg/m$^2$) Comparative | 1.1 | 1.2 | 0.20 | X |
| (Comparative Example) 27 | (50 mg/m$^2$) II-1 | Compound B (50 mg/m$^2$) Comparative | 1.0 | 1.1 | 0.19 | X |
| (Comparative Example) 28 | (50 mg/m$^2$) II-1 | Compound C (50 mg/m$^2$) Comparative | 1.8 | 2.1 | 0.26 | Δ |
| (Comparative Example) | (50 mg/m$^2$) | Compound D (50 mg/m$^2$) | | | | |

The following comparative compounds were used:

Comparative Compound A $$C_{16}H_{33}O(CH_2CH_2O)_{10}H$$

Comparative Compound B $$C_{16}H_{33}OCH_2\underset{\underset{OH}{|}}{C}HCH_2(CH_2CH_2O)_{10}H$$

Comparative Compound C $$C_{15}H_{31}COO(CH_2CH_2O)_{15}H$$

Comparative Compound D

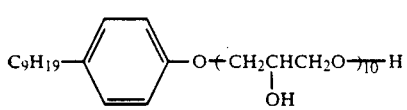

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, at least one layer of the material containing the combination of a lubricant in an amount of from 0.0001 to 2.0 grams per square meter of the photographic material and a water-soluble compound represented by formula (I) in ana amount of from 0.0001 to 2.0 grams per square meter of the photographic material:

$$A\text{-}X\text{-}Y\text{-}B \qquad (I)$$

wherein A represents s substituted or unsubstituted alkyl group, a substituted or unsubstituted alkenyl group or a substituted or unsubstituted aryl group each containing from 8 to 25 atoms; x represents —O—, $$-\underset{\underset{O}{\|}}{C}O-,$$

$$-S-,$$

$$-\underset{\underset{R}{|}}{N}-,\quad -\underset{\underset{R}{|}}{C}ON-\quad \text{or}\quad -SO_2\underset{\underset{R}{|}}{N}-,$$

wherein R represents an alkyl group containing from 1 to 10 carbon atoms or group -Y-B; Y represents a group containing at least $-(CH_2CH_2O)_a-$ and $$-(CH_2\underset{\underset{OH}{|}}{C}HCH_2O)_b-,$$

wherein a is an integer from 5 to 50, and b is an integer 2 to 20; B represents hydrogen, an alkyl group containing at most 8 carbon atoms, or a phenyl group.

2. The silver halide light-sensitive material as claimed in claim 1, wherein A represents a group selected from $C_8H_{17}$—, —$C_{16}H_{33}$,

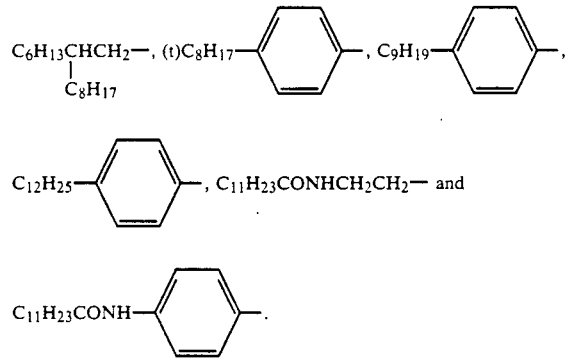

3. The silver halide light-sensitive material as claimed in claim 1, wherein Y represents a group selected from :

$$-(CH_2CH_2O)_{10}-(CH_2\underset{\underset{OH}{|}}{C}HCH_2O)_3-,$$

$$-(CH_2CH_2O)_{10}-(CH_2\underset{\underset{OH}{|}}{C}HCH_2O)_5-(CH_2CH_2O)_{10}-,$$

$$-(CH_2\underset{\underset{OH}{|}}{C}HCH_2O)_3-(CH_2CH_2O)_{10}-, \text{ and}$$

$$-(CH_2\underset{\underset{OH}{|}}{C}HCH_2O)_3-(CH_2CH_2O)_{20}-(CH_2\underset{\underset{OH}{|}}{C}HCH_2O)_3-.$$

4. The silver halide light-sensitive material as claimed in claim 1, wherein B represents H, $C_4H_9$— or

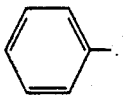

5. The silver halide light-sensitive material as claimed in claim 1, wherein said compound represented by formula (I) and said lubricant are each contained in said silver halide emulsion layer.

6. The silver halide light-sensitive material as claimed in claim 1, wherein said compound represented by formula (I) and said lubricant are each contained in a backing layer or a surface protective layer.

7. The silver halide light-sensitive material as claimed in claim 1, wherein said compound represented by formula (I) is present in an amount of from 0.0005 to 0.3 gram per square meter of said light-sensitive material.

8. The silver halide light-sensitive material as claimed in claim 1, wherein said lubricant is represented by formula (II):

$$R_1-COO-R_2 \qquad \text{(II)}$$

wherein $R_1$ and $R_2$ each represents an alkyl group containing from 10 to 20 carbon atoms.

9. The silver halide light-sensitive material as claimed in claim 1, wherein said lubricant is represented by formula (III):

$$\begin{array}{l} CH_2OCOR_3 \\ | \\ CHOCOR_4 \\ | \\ CH_2OCOR_5 \end{array} \qquad \text{(III)}$$

wherein $R_3$, $R_4$ and $R_5$ each represents an alkyl group containing from 10 to 20 carbon atoms.

10. The silver halide light-sensitive material as claimed in claim 1, wherein said lubricant is represented by formula (IV):

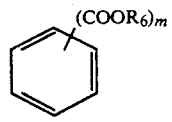

(IV)

wherein $R_6$ represents an alkyl group containing for m10 to 24 carbon atoms, and m is an integer from 2 to 4.

11. The silver halide light-sensitive material as claimed in claim 1, wherein said lubricant is represented by formula (V):

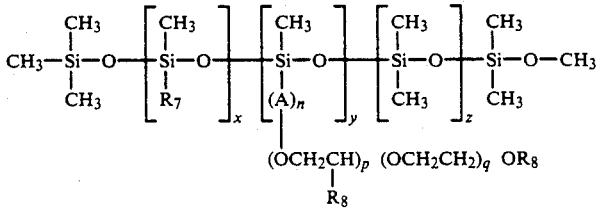

(V)

wherein $R_7$ represents an aliphatic group or an aryl group $R_8$ represents an alkyl group or an alkoxyalkyl group; A represents a divalent aliphatic hydrocarbon group; n is 0 or an integer of 1 to 12; p is 0 or an integer from 1 to 50; q is an integer from 2 to 50; x is 0 or an integer from 1 to 100; y is an integer from 1 to 50; and z is 0 or an integer from 1 to 100; and x+y+z is an integer from 5 to 250.

12. The silver halide light-sensitive material as claimed in claim 11, wherein q is an integer from 20 to 30 and x+y+z is an integer from 10 to 50.

13. The silver halide light-sensitive material as claimed in claim 1, wherein said lubricant is represented by formula (VI):

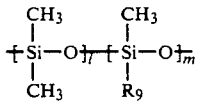

(VI-1)

wherein said compound is a cyclic compound, or a linear chain compound having terminal groups represented by formula (VI-2):

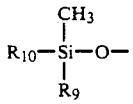

(VI-2)

wherein $R_9$ represents an alkyl group containing from 5 to 20 carbon atoms, a cycloalkyl group, an alkoxyalkyl group, an arylalkyl group, an aryloxyalkyl group or a glycidyloxyalkyl group $R_{10}$ represents an alkyl group containing from 1 to 20 carbon atoms, a cycloalkyl group containing from 5 to 20 carbon atoms, an alkoxyalkyl group, an arylalkyl group, an aryloxyalkyl group or a glycidyloxyalkyl group; l is 0 or an integer from 1 to 1,000; m is an integer from 1 to 1,000; and l+m is an integer from 2 to 1,000.

14. The silver halide light-sensitive material as claimed in claim 13, wherein l+m is a number from 2 to 500.

15. The silver halide light-sensitive material as claimed in claim 1, wherein said lubricant is represented by formula (VII):

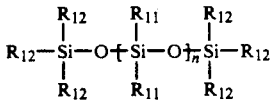

(VII)

wherein $R_{11}$ represents an alkyl group containing from 1 to 3 carbon atoms; $R_{12}$ represents an alkyl group containing from 1 to 3 carbon atoms or an alkoxy group containing 1 to 2 carbon atoms; n is 0 or an integer from 1 to 2000.

16. The silver halide light-sensitive material as claimed in claim 1, wherein said lubricant is present in an amount from 0.005 to 0.2 grams per square meter of said light-sensitive material.

17. The silver halide light-sensitive material as claimed in claim 5, wherein said lubricant is present in an amount from 0.0001 to 2.0 grams per square meter of said light-sensitive material.

18. The silver halide light-sensitive material as claimed in claim 6, wherein said lubricant is present in an amount from 0.005 to 0.2 grams per square meter of said light-sensitive material.

* * * * *